US005921329A

United States Patent [19]

Armstrong

[11] Patent Number: 5,921,329

[45] **Date of Patent: *Jul. 13, 1999**

[54] INSTALLATION AND REMOVAL OF TOP DRIVE UNITS

[75] Inventor: James E. Armstrong, Crosby, Tex.

[73] Assignee: Sundowner Offshore Services, Inc., Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/725,352

[22] Filed: Oct. 3, 1996

[51] Int. Cl.[6] ..... E21B 19/00

[52] U.S. Cl. ..... 175/57; 175/87; 175/203

[58] Field of Search ..... 175/87, 162, 203, 175/220, 57

[56] References Cited

U.S. PATENT DOCUMENTS

| | | | |
|---|---|---|---|
| 3,754,606 | 8/1973 | Ward | 173/145 |
| 4,830,119 | 5/1989 | Haney et al. | 173/21 |
| 4,832,552 | 5/1989 | Skelly | 414/22.54 |
| 4,865,135 | 9/1989 | Moses | 175/57 |
| 5,038,871 | 8/1991 | Dinsdale | 175/52 |
| 5,107,940 | 4/1992 | Berry | 175/85 |
| 5,211,251 | 5/1993 | Woolslayer | 175/85 |
| 5,251,709 | 10/1993 | Richardson | 175/162 X |
| 5,381,867 | 1/1995 | Berry | 175/85 |
| 5,433,279 | 7/1995 | Tessari et al. | 173/213 |
| 5,501,286 | 3/1996 | Berry | 175/203 X |

FOREIGN PATENT DOCUMENTS

| | | |
|---|---|---|
| 2079817 | 1/1982 | United Kingdom . |
| 2119749 | 11/1983 | United Kingdom . |
| 2228025 | 8/1990 | United Kingdom . |

OTHER PUBLICATIONS

"Reinventing the Rig", *CPA Review*, Oct. 1991.

"Portable Hydraulic Top Drive", *TESCO Drilling Technology*, Jan. 1992.

"Drilling Technology for the Nineties", *Canrig Drilling Technology, Ltd.*

"Land Rigs Benefit from Portable Top Drive System", *Oil & Gas Journal*, No. 11, Tulsa, Oklahoma, Mar. 14, 1994.

"Canrig Top Drive Drilling Systems", Canadian Rig Ltd., Calgary, Alberta, Canada.

B. Jackson, "Portable Top Drive Cuts Horizontal Drilling Costs", *World Oil*, No. 11, Houston, Texas, Nov. 1993.

*World Oil Composite Catalog* '92/'93 (vol. 2), Gulf Publishing Company, Houston, Texas, p. 3464.

*World Oil Composite Catalog* '92/'93 (vol. 2), Gulf Publishing Company, Houston, Texas, pp. 540–541.

*Primary Examiner*—William P. Neuder

*Attorney, Agent, or Firm*—Baker & Botts, L.L.P.

[57] ABSTRACT

The invention features an assembly for use with a drilling rig having a mast and a first torque guide section mounted to the mast. The first torque guide section has an end and a coupler mounted near the end. The assembly includes a second torque guide section and a fastener mounted to the second torque guide section. The fastener is configured to form a releasable pivotal connection with the coupler.

11 Claims, 4 Drawing Sheets

INSTALLATION AND REMOVAL OF TOP DRIVE UNITS

BACKGROUND

The invention relates to the installation and removal of top drive units.

A drilling rig may support use of a top drive unit used to actuate a drill bit via a drill string extending downwardly into a surface of the earth. The top drive unit is typically connected to one end of the drill string with the other end of the drill string connected to the drill bit. As the drill bit bores downwardly into the surface of the earth, a winch of the rig lowers the top drive unit to follow movement of the drill bit and drill string. For purposes of guiding the top drive unit and distributing the torsional forces produced by the top drive unit, the top drive unit is typically slidably mounted to one or two guide rails which extend along an upwardly extending mast of the rig.

SUMMARY

In general, in one aspect, the invention features an assembly for use with a drilling rig having a mast and a first torque guide section mounted to the mast. The first torque guide section has an end and a coupler mounted near the end. The assembly includes a second torque guide section and a fastener mounted to the second torque guide section. The fastener is configured to form a releasable pivotal connection with the coupler.

Implementations of the invention may include one or more of the following. The coupler may include a hook, and the fastener may include a pin. The assembly may also include a top drive unit mounted to the second torque guide section. The connection may allow the second torque guide section to pivot about the coupler to form a torque guide rail that includes the first and second torque guide sections.

In general, in another aspect, the invention features an assembly for use with a drilling rig having a mast. The assembly has a first torque guide section having an end and a coupler mounted near the end. The assembly also has a second torque guide section and a fastener mounted to the second torque guide section. The fastener is configured to form a releasable pivotal connection with the coupler.

In general, in another aspect, the invention includes a method for use with a drilling rig having a mast and a first torque section mounted to the mast. The first torque guide section has an end. The method includes mounting a top drive unit on a second torque guide section, and after mounting, connecting the first and second torque guide sections together to form a torque guide rail that includes the first and second torque guide sections.

Implementations of the invention may include one or more of the following. The first torque guide section may have a pivot point and a longitudinal axis, and the second torque guide section may have a longitudinal axis. The connecting may include hooking the second torque guide section to the pivot point and pivoting the second torque guide section about the pivot point to align the longitudinal axis of the second torque guide section with the longitudinal axis of the first torque guide section.

In general, in another aspect, the invention features a method for use with a drilling rig having a mast and an upwardly extending first torque guide section having a longitudinal axis mounted to the mast. The first torque guide section has an end. The method includes horizontally positioning an end of a second torque guide section near the end of the first torque guide section. The second torque guide section has a longitudinal axis. The method also includes pivotally connecting the ends of the first and second torque guide sections, rotating the second torque guide section to align the longitudinal axis of the first torque guide section with the longitudinal axis of the second torque guide section, and rigidly securing the first and second torque guide sections together.

Implementations of the invention may include securing the second torque guide section to the mast.

Among the advantages of the invention are one or more of the following. A top drive unit that has failed may be quickly removed from the torque guide. A top drive unit may be quickly installed on the torque guide.

Other advantages and features will become apparent from the following description and from the claims.

DESCRIPTION

Figure 1:
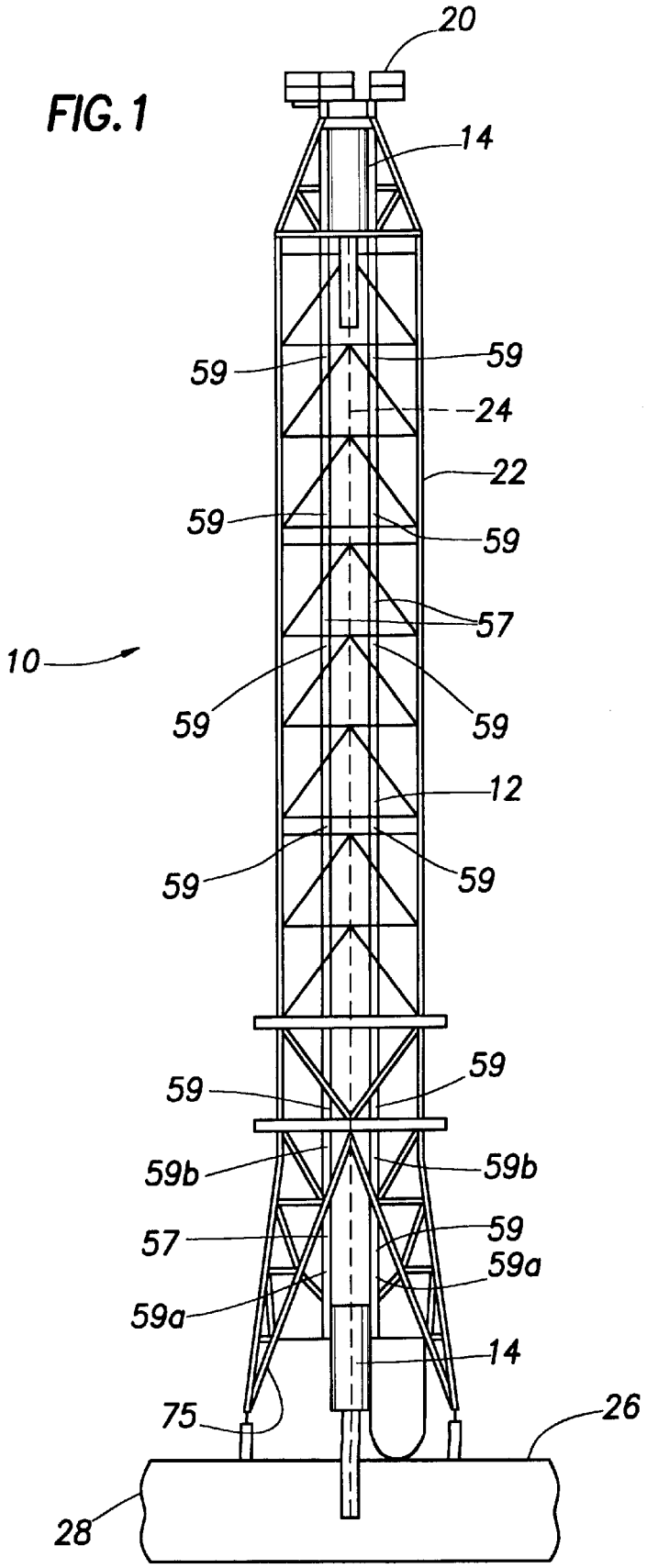
FIG. 1 is a front view of a drilling rig.

As shown in FIG. 1, a torque guide 12 of a drilling rig 10 is formed from two parallel upwardly extending I-beam torque guide rails 57. The rails 57 guide a top drive unit 14 that slides in between, and the rails 57 distribute torsional forces produced by the top drive unit 14 to a lower substructure 28 of the rig 10. Each rail 57 is formed from linearly connected I-beam sections 59. Two 59*a* (one for each rail 57) of the sections 59 located at the bottom of the rails 57 may be installed or removed with the top drive unit 14 mounted to the sections 59*a*, and for purposes of installation or removal, the sections 59*a* are accessible through a V-opening 75 in a mast 22 of the rig 10.

Unlike the sections 59*a*, the other sections 59 of the torque guide 12 are permanently mounted to the mast 22. Therefore, due to the detachable nature of the sections 59*a* and the capability of moving the top drive unit 14 with the sections 59*a* as a single unit, the time required to install the top drive unit 14 on the torque guide 12 is minimized. Likewise, the time required to remove the top drive unit 14 (e.g., a damaged top drive unit 14) from the torque guide 12 is also minimized. Thus, a damaged top drive unit 14 may be quickly replaced, thereby reducing down time of the drilling rig 10.

Figure 2:
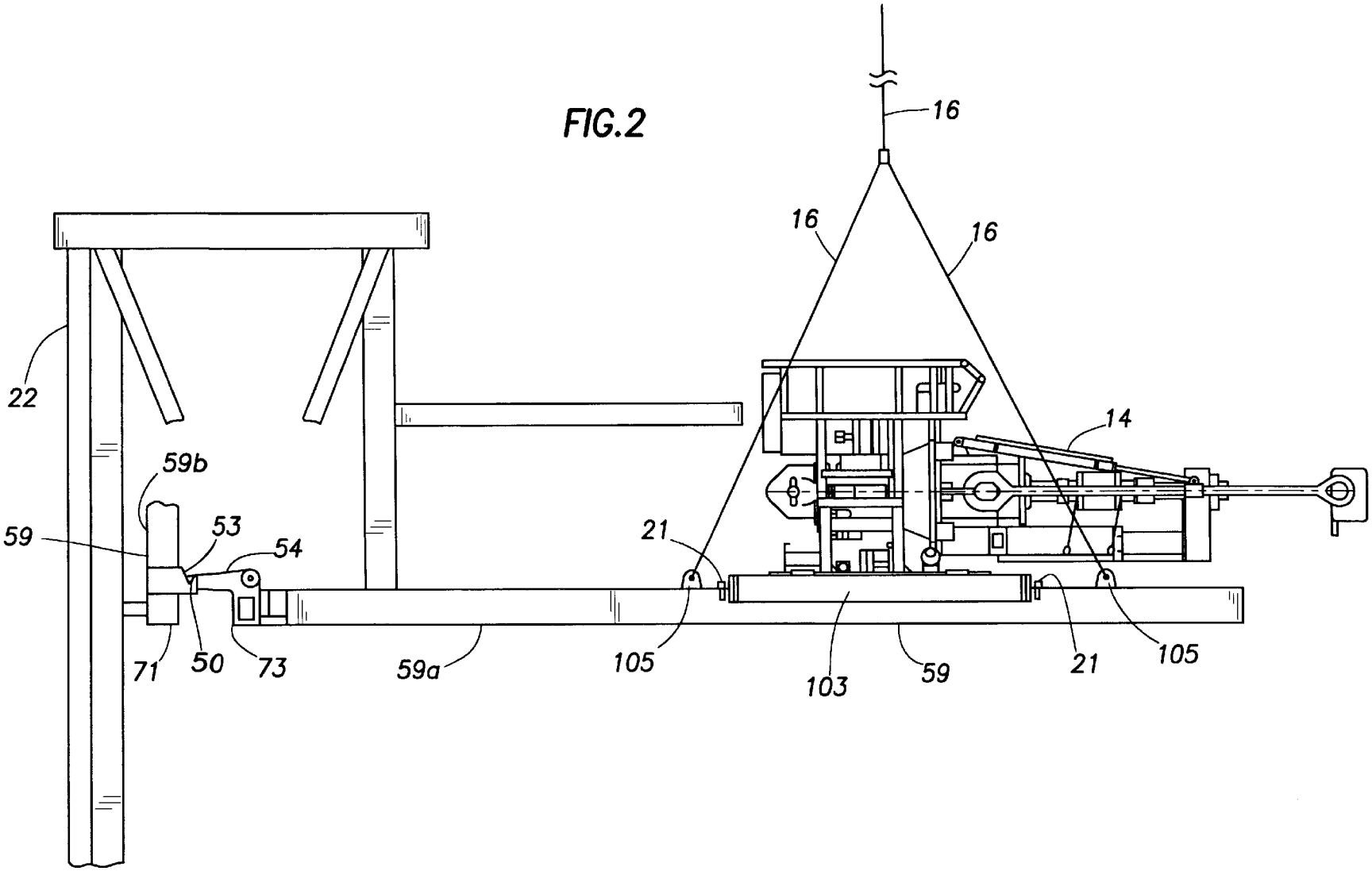
FIG. 2 is a side view of the drilling rig showing a top drive unit assembled on a section of a torque guide rail.
Figure 3:
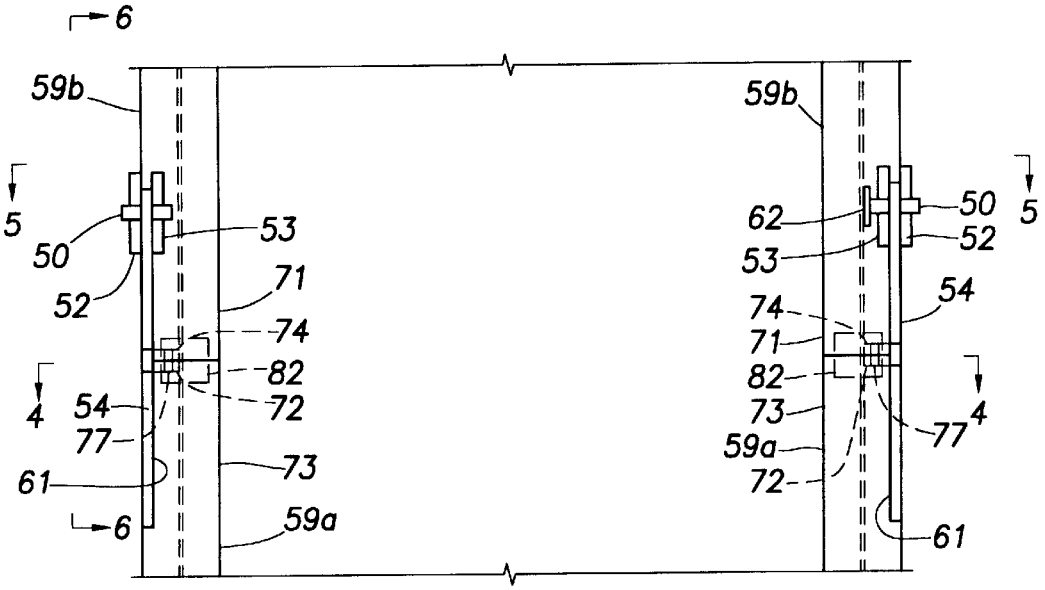
FIG. 3 is a front view of a hook and pin connection between sections of the torque guide rail.
Figure 4:
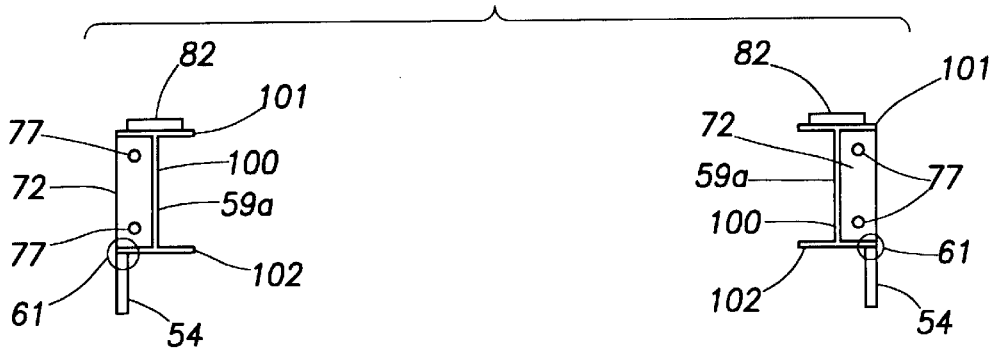
FIG. 4 is a cross-sectional view taken along line 4—4 of FIG. 3.
Figure 5:
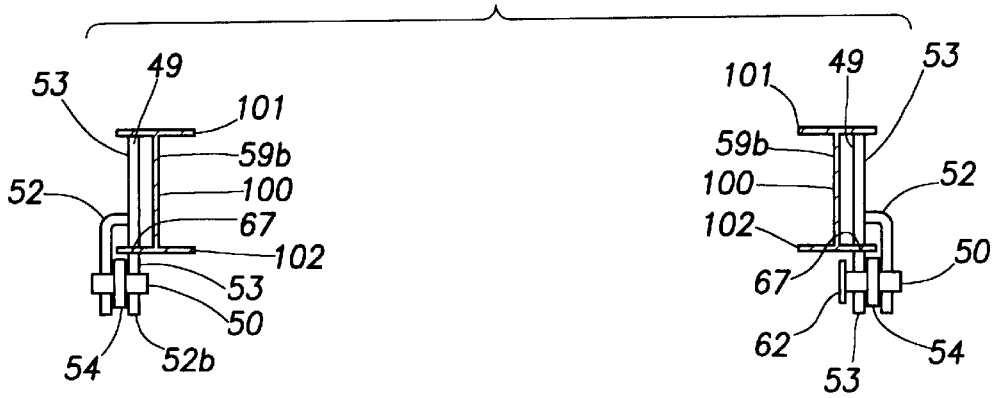
FIG. 5 is a cross-sectional view taken along line 5—5 of FIG. 3.
Figure 6:
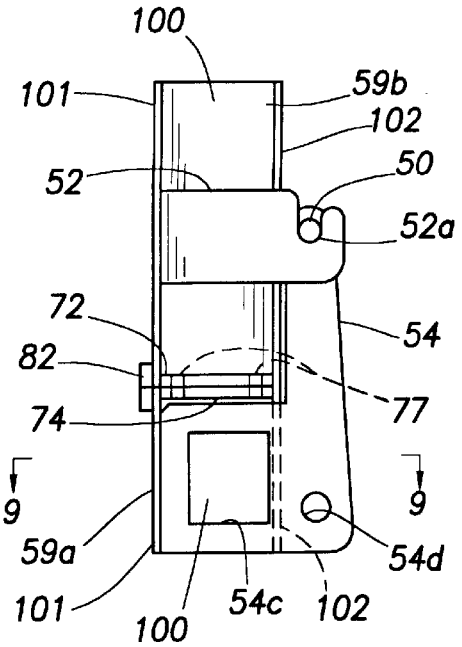
FIG. 6 is a cross-sectional view taken along line 6—6 of FIG. 3.
Figure 7:
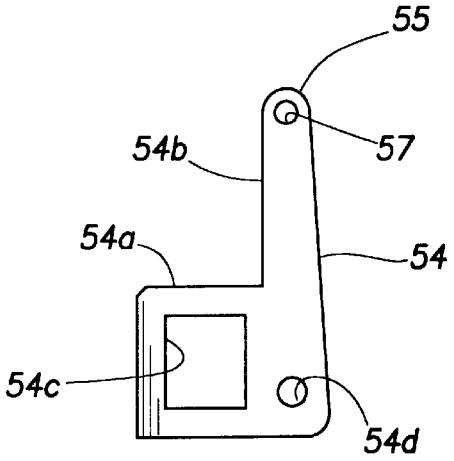
FIG. 7 is a side view of an arm of the hook and pin connection.
Figure 8:
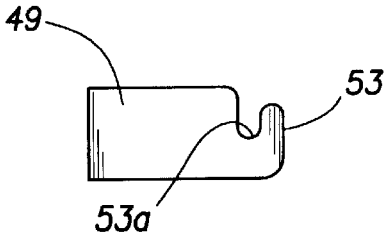
FIG. 8 is a side view of a hook of the hook and pin connection.
Figure 9:
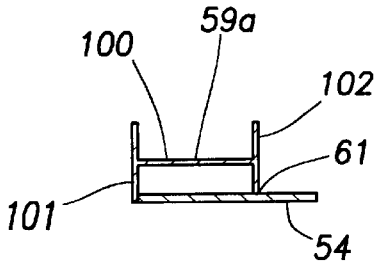
FIG. 9 is a cross-sectional view taken along line 9—9 of FIG. 6.

As shown in FIGS. 2 and 3, for purposes of installing the top drive unit 14 on the torque guide 12, the top drive unit 14 is first slidably mounted to the two sections 59*a* before the sections 59*a* are connected to the remaining sections 59 to complete the torque guide 12. After mounting, the top drive unit 14 is then secured in place via pins 21 extending through flanges 102 of the sections 59*a* upon which the top drive unit 14 would otherwise slide, as described below. The top drive unit 14 and sections 59*a* may, for example, form a spare assembly. If the top drive unit 14 currently in use on the rig 10 fails, the spare assembly may then be installed.

For purposes of linearly connecting the sections 59*a* to adjacent sections 59*b* (already mounted to the mast 22) of the torque guide 12, both sections 59*a* (with the top drive unit 14 mounted) are placed on a rig floor 26 of the rig 10 such that the longitudinal axis of each section 59*a* is horizontal. A winch located a sufficient height above the rig floor 26 (e.g., a winch located at a crown 20 of the rig) then lowers cables 16 for connection to the sections 59*a* through the cable fasteners 105 secured to the sections 59*a*. The sections 59*a* are kept in the horizontal orientation while the winch vertically hoists the sections 59*a* to a position where ends 73 of the sections 59*a* are near the free, or unconnected, ends 71 of the sections 59*b*. Near the ends 71 and 73, the sections 59*a* and 59*b* are then pivotally connected. After the pivotal connection, the winch releases tension on the cables 16 and allows the sections 59*a* to downwardly pivot about the pivotal connection. The sections 59 pivot until the longitudinal axis of the sections 59*a* become aligned with the longitudinal axis of the sections 59*b*.

To complete installation, the sections 59*a* and 59*b* are rigidly secured together near the ends 71 and 73, and the sections 59*a* are secured to the mast 22 (e.g., by a threaded bolt secured by a pipe union). A winch in the crown 20 is then attached to the top drive unit 14 with cables used to lower and raise the top drive unit 14 during drilling, the pins 21 are subsequently removed, and then the top drive unit 14 may slide over the entire torque guide 12.

For purposes of removing the top drive unit 14 (e.g., a top drive unit that is not functioning properly), the winch in the crown 20 lowers the top drive unit 14 until the top drive unit 14 is positioned in its entirety on the sections 59*a*. The top drive unit 14 is then secured to the sections 59*a* via the pins 21. A winch located a sufficient height above the rig floor 26 is then attached via the cables 16 to the sections 59*a*, and the sections 59*a* are then detached from the mast 22. The rigid securements between the sections 59*a* and 59*b* are then removed, and the winch in the crown 20 used to raise and lower the top drive unit 14 is then disconnected from the top drive unit 14. The winch attached to the sections 59*a* via the cables 16 then pivots the sections 59*a* upwardly about the pivotal connection until the longitudinal axis of both sections 59*a* are horizontal. Once horizontal, the sections 59*a* (with the top drive unit 14 mounted) are disconnected from the pivotal connection. Keeping the sections 59*a* horizontal, the winch then lowers the sections 59*a* (and top drive unit 14) to the rig floor 26 where the sections 59*a* and the top drive unit 14 may be removed.

As shown in FIGS. 4–9, the I-beam sections 59 are formed from a web 100 and two parallel flanges 101 and 102 perpendicular to the web 100. The orientation of the guide rails 57 places the flanges 101 of both guide rails 57 in substantially the same plane and the flanges 102 of both guide rails 57 in substantially in the same plane.

The top drive unit 14 has two sleeves 103 for guiding the top drive unit 14 along the rails 57. Each sleeve 103 is configured to slidably mount the top unit 14 to the edge of the flange 102 closest to the other guide rail 57.

For purposes of forming the pivotal connection between the sections 59*a* and 59*b*, each section 59*a* has a planar arm 54 mounted to the section 59*a*. The arm 54 extends along the longitudinal axis of the section 59*a* toward and beyond the end 73. The arm 54 positions a pin 50 for connection with two hooks 52 and 53 that are mounted to the sections 59*b* near the ends 71. The longitudinal axis of the pin 50 is perpendicular to the web 100. When pivotally connected, a top 55 of the arm 54 is placed between the hooks 52 and 53 with the pin 50 engaging recesses 52*a* and 53*a* of the hooks 52 and 53, respectively.

The hook 53 has one end 49 connected to the flange 101 of the section 59*b* near the edge of the flange 101 farthest from the other section 59*b*. The hook 53 extends perpendicularly away from the flange 101 toward the flange 102, through a notch 67 in the flange 102, and beyond the flange 102. The hook 52 is formed from a right angle arm which extends perpendicularly away from the hook 53 between the flanges 101 and 102 and extends around the edge of the flange 102 to align the recess 52*a* with the recess 53*a*.

The arm 54 has a generally rectangular plate 54*a* which is mounted between the flanges 101 and 102 on the side of the section 59*b* farthest from the other section 59*b*. For purposes of welding the arm 54 to the web 100, the plate 54*a* has a rectangular opening 54*c*. The plate 54*a* is parallel to the web 100 and extends through a rectangular notch 61 formed in the flange 102. An extension 54*b* of the arm 54 is parallel with the longitudinal axis of the section 59*b* and extends from the plate 54*a* to position the pin 50 near the end of the extension 54*b*. Near the union of the extension 54*a* and the plate 54*b*, the arm 54 has an opening 54*d*. For purposes of securing the pin 50 to the arm 54, the extension 54*b* has an opening 57 through which the pin 50 extends. An end of the pin 50 on one of the sections 59*a* has a metal cap 62 to prevent lateral movement of the sections 59*a* from dislodging the pivotal connection.

For purposes of rigidly securing the sections 59*a* and 59*b* together, each section 59*b* has a mounting plate 72 perpendicular to the longitudinal axis of the section 59*b* and mounted to the end 71 of the section 59*b*. Likewise, each section 59*a* has a flat plate 74 perpendicular to the longitudinal axis of the section 59*a* and mounted to the end 73 of the section. When the sections 59*a* and 59*b* are aligned, surfaces of the plates 72 and 74 contact each other. Two bolt holes in the plate 72 are aligned with two bolt holes in the plate 74 which allows two bolts 77 to extend though the plates 72 and 74 and rigidly secure the sections 59*a* and 59*b* together. The heads of the bolts 77 are tacked welded to hold the bolts 77 in place.

For purposes of limiting the pivoting movement of the sections 59*a* during installation or removal of the top drive unit 14, each section 59*b* has a rectangular stop plate 82 mounted to the surface of the flange 101 farthest from the web 101. The stop plate 82 is parallel to the flange 101 and extends beyond the end 71 to prevent pivoting of the sections 59*b* beyond alignment of the sections 59*a* and 59*b*.

Other embodiments are within the scope of the following claims. For example, the top drive unit may be a portable top drive unit, and the portable tope drive unit may slide on a monorail torque guide rail.

What is claimed is:

1. An assembly for use in the installation and removal of a top drive unit in a drilling rig having a mast and a first torque guide section mounted to the mast, the first torque guide section having an end and a coupler mounted near the end, the assembly comprising:

a second torque guide section; and a fastener mounted to the second torque guide section, the fastener configured to form a releasable pivotable connection with the coupler; wherein the second torque guide section is pivotable about the coupler between a first position in which the first torque guide section and the second torque guide section are not substantially axially aligned and a second position in which the first torque guide section and the second torque guide section are substantially axially aligned to form a torque guide rail.

2. The assembly of claim 1 wherein the coupler comprises a hook.

3. The assembly of claim 1 wherein the fastener comprises a pin.

4. The assembly of claim 1 further comprising a top drive unit mounted to the second torque guide section.

5. An assembly for use in the installation and removal of a top drive unit in a drilling rig having a mast, the assembly comprising:

a first torque guide section having an end and a coupler mounted near the end;

a second torque guide section; and a fastener mounted to the second torque guide section, the fastener configured to form a releasable pivotable connection with the coupler; wherein the second torque guide section is pivotable about the coupler between a first position in which the first torque guide section and the second torque guide section are not substantially axially aligned and a second position in which the first torque guide section and the second torque guide section are substantially axially aligned to form a torque guide rail.

6. The assembly of claims 5 wherein the fastener comprises a hook.

7. The assembly of claim 5 wherein the fastener comprises a pin.

8. The assembly of claim 5, further comprising a top drive unit mounted to the one torque guide section.

9. A method for use with a drilling rig having a mast and a first torque section mounted to the mast, the first torque guide section having a pivot point, a longitudinal axis, and an end, the method comprising:

mounting a top drive unit on a second torque guide section, the second torque guide section having a longitudinal axis;

after mounting, hooking the second torque guide section to the pivot point; and pivoting the second torque guide section about the pivot point to align the longitudinal axis of the second torque guide section with the longitudinal axis of the first torque guide section.

10. A method for use with a drilling rig having a mast and an upwardly extending first torque guide section having a longitudinal axis mounted to the mast, the first torque guide section having an end, the method comprising:

horizontally positioning an end of a second torque guide section near the end of the first torque guide section, the second torque guide section having a longitudinal axis;

pivotally connecting the ends of the first and second torque guide sections;

rotating the second torque guide section to align the longitudinal axis of the first torque guide section with the longitudinal axis of the second torque guide section; and rigidly securing the first and second torque guide sections together.

11. The method of claim 10 further comprising securing the second torque guide section to the mast.

* * * * *